US008371258B2

(12) United States Patent
Fujii et al.

(10) Patent No.: US 8,371,258 B2
(45) Date of Patent: Feb. 12, 2013

(54) LASH ADJUSTER

(75) Inventors: Hiroki Fujii, Aichi (JP); Kimihiko Todo, Aichi (JP)

(73) Assignee: OTICS Corporation, Aichi (JP)

( * ) Notice: Subject to any disclaimer, the term of this patent is extended or adjusted under 35 U.S.C. 154(b) by 261 days.

(21) Appl. No.: 12/865,967

(22) PCT Filed: Feb. 6, 2009

(86) PCT No.: PCT/JP2009/052072

§ 371 (c)(1),
(2), (4) Date: Aug. 3, 2010

(87) PCT Pub. No.: WO2009/101907

PCT Pub. Date: Aug. 20, 2009

(65) Prior Publication Data

US 2011/0000452 A1 Jan. 6, 2011

(30) Foreign Application Priority Data

Feb. 13, 2008 (JP) ..... 2008-032059

(51) Int. Cl.
*F01L 1/14* (2006.01)

(52) U.S. Cl. ..... 123/90.58; 123/90.52

(58) Field of Classification Search ..... 123/90.43, 123/90.58, 90.52, 90.55
See application file for complete search history.

(56) References Cited

U.S. PATENT DOCUMENTS

| | | | | |
|---|---|---|---|---|
| 4,530,319 | A * | 7/1985 | Honda | 123/90.46 |
| 4,541,373 | A * | 9/1985 | Ishida | 123/90.55 |
| 4,807,576 | A | 2/1989 | Sonoda et al. | |
| 5,361,733 | A | 11/1994 | Spath et al. | |
| 5,398,648 | A | 3/1995 | Spath et al. | |
| 5,622,147 | A | 4/1997 | Edelmayer | |
| 7,493,879 | B2 | 2/2009 | Fujii et al. | |

FOREIGN PATENT DOCUMENTS

EP 0 608 925 A1 8/1994

(Continued)

OTHER PUBLICATIONS

Extended European Search Report dated May 6, 2011 for Application No. EP 09 70 9467.

(Continued)

*Primary Examiner* — Zelalem Eshete
(74) *Attorney, Agent, or Firm* — Smith, Gambrell & Russell, LLP

(57) ABSTRACT

A lash adjuster includes a cylindrical body, a cylindrical plunger, a low pressure chamber defined in the plunger, a high pressure chamber defined in a hollow lower interior of the body and filled with an operating fluid, a check valve allowing the operating fluid to flow into the high pressure chamber when in a valve-opened state and cutting off flow of the operating fluid from the high pressure chamber into the low pressure chamber when in a valve-closed state. A retainer of the check valve includes a base plate and a cylindrical portion extending upward from an outer circumferential edge of the base plate so as to surround the valve element. The base plate includes a central portion on which the valve element is placed and which has an upper surface formed with a swollen portion. The cylindrical portion has a plurality of openings formed through it circumferentially equiangularly.

17 Claims, 3 Drawing Sheets

FOREIGN PATENT DOCUMENTS

| | | | |
|---|---|---|---|
| EP | 1 710 401 | A1 | 10/2006 |
| GB | 2 185 549 | A | 7/1987 |
| JP | 58-178812 | | 10/1983 |
| JP | H02-46006 | U | 3/1990 |
| JP | 5-288020 | | 11/1993 |
| JP | 9-324609 | | 12/1997 |

OTHER PUBLICATIONS

International Search Report for PCT/JP2009/052072 dated Mar. 3, 2009 (English and JP language version).
Japanese Office Action dated Jun. 26, 2012 for Japanese Application No. 2008-032059 (English translation attached).

* cited by examiner

LASH ADJUSTER

TECHNICAL FIELD

The present invention relates to a hydraulic lash adjuster.

BACKGROUND ART

Japanese Patent Application Publication No. JP-A-H05-288020 discloses a hydraulic lash adjuster used in valve gears. The lash adjuster comprises a bottomed cylindrical body and a bottomed cylindrical plunger which is accommodated in the body so as to be movable upward and downward. The plunger has an upper end which protrudes out of the body and is adapted to support a rocker arm.

The plunger has an interior serving as a low pressure chamber, and the body includes a lower interior that is partitioned by a bottom wall of the plunger thereby to serve as a high pressure chamber. The bottom wall of the plunger has an opening serving as a valve hole of a check valve. A hydraulic fluid is supplied into the low pressure chamber, and part of the hydraulic fluid in the low pressure chamber is caused to flow through the valve hole into the high pressure chamber, filling the high pressure chamber. The high pressure chamber also accommodates a valve element constituting a check valve and a valve spring biasing the valve element to the valve hole side (a valve-closed direction). When the plunger stands still, the bias of the valve spring holds the valve element in a valve-closed position where the valve hole is closed by the valve element, whereupon the check valve is closed.

When the plunger is moved upward, the vale element is moved downward against the bias of the valve spring, whereupon the check valve is opened. As a result, the hydraulic fluid in the low pressure chamber flows into the high pressure chamber. On the other hand, when the plunger is moved downward, the operating fluid in the high pressure chamber flows through a slight gap between an inner circumferential wall of the body and an outer circumferential wall of the plunger while the check valve is retained in the valve-closed state. As a result, the operating fluid flowing out of the high pressure chamber is returned through a communication hole extending through the circumferential wall of the plunger into the low pressure chamber.

When the rotating speed of the valve gear is increased in the above-described lash adjuster, a moving speed of the valve element is increased. Accordingly, an inertia force moves the valve element far away from the valve hole when the plunger is moved upward, whereupon valve element's arrival at the valve-closed position is retarded in the downward movement of the plunger. This results in concern that an amount of downward movement of the plunger becomes excessively large.

Increasing a biasing force of the valve spring is considered as a means for enhancing return of the valve element to the valve-closed position. In this case, however, there is a possibility that the valve element is kept closing the valve hole or that an opening degree of the valve hole becomes insufficient such that a smooth upward movement of the plunger is adversely affected.

SUMMARY

Therefore, an object thereof is to avoid delay in the movement of the valve element to the valve-closed position during downward movement of the plunger.

The present invention provides a lash adjuster comprising a bottomed cylindrical body; a bottomed cylindrical plunger which is movable upward and downward while being in sliding contact with an inner circumferential surface of the body and which is biased upward by a return spring; a low pressure chamber defined in the plunger for storing an operating fluid; a high pressure chamber defined in a hollow lower interior of the body and separated from the low pressure chamber by a bottom wall of the plunger, the high pressure chamber being configured to be filled with the operating fluid; and a check valve which allows the operating fluid to flow from the low pressure chamber into the high pressure chamber when in a valve-opened state and which cuts off flow of the operating fluid from the high pressure chamber into the low pressure chamber when in a valve-closed state. The check valve includes a valve orifice extending through the bottom wall of the plunger, a retainer disposed in the high pressure chamber so as to be moved upward and downward with the plunger, and a valve element which is vertically movable in the high pressure chamber between a valve-opened position at which the valve element is placed on the retainer while spaced from the valve orifice and a valve-closed position which is located higher than the valve-opened position and at which the valve element closes the valve orifice. The valve element is held in the valve-opened position by self-weight when the plunger remains still. The retainer includes a base plate on which the valve element located at the valve-opened position is placed and a cylindrical portion extending upward from an outer circumferential edge of the base plate so as to surround the valve element. The cylindrical portion has a plurality of openings formed therethrough circumferentially equiangularly, and the base plate includes a central portion on which the valve element is placed and which has an upper surface formed with a swollen portion.

An invention embodiment includes a base plate on which the valve element located at the valve-opened position is placed; and a cylindrical portion extending upward from an outer circumferential edge of the base plate so as to surround the valve element, and wherein the cylindrical portion has an opening formed therethrough, and the base plate includes an axially thicker-in-material central portion, with the central portion having an upper surface on which the valve element is placed in the valve opened position.

An invention embodiment includes a base plate on which the valve element located at the valve-opened position is placed, and a cylindrical portion extending upward from an outer circumferential edge of the base plate so as to surround the valve element, wherein the cylindrical portion has an opening formed therethrough; and the base plate includes a central portion, with the central portion having an upper surface on which the valve element is placed in the valve opened position, and wherein there are a plurality of circumferentially spaced flow openings in the cylindrical portion having lower edging that falls below a height level of the upper surface of the central portion, and wherein the valve orifice has an opening edge which is located at the high pressure chamber side and formed with a sheet surface having a diameter expanded to the high pressure chamber side, and wherein the valve element has an upper end which is held surrounded by the sheet surface both when the valve element is in the valve-opened and valve-closed positions.

When the plunger is moved upward, the operating fluid in the low pressure chamber flows through the valve hole into the high pressure chamber while the valve element is retained at the valve-opened position by self-weight. In this case, the valve element is maintained on the retainer even if an ascend speed of the plunger is high. Accordingly, a distance between the valve element and the valve hole is not prevented from being increased. As a result, when the plunger subsequently starts descending, the valve element is promptly moved to the valve-closed position thereby to close the valve hole.

DETAILED DESCRIPTION

First Embodiment

Figure 1:
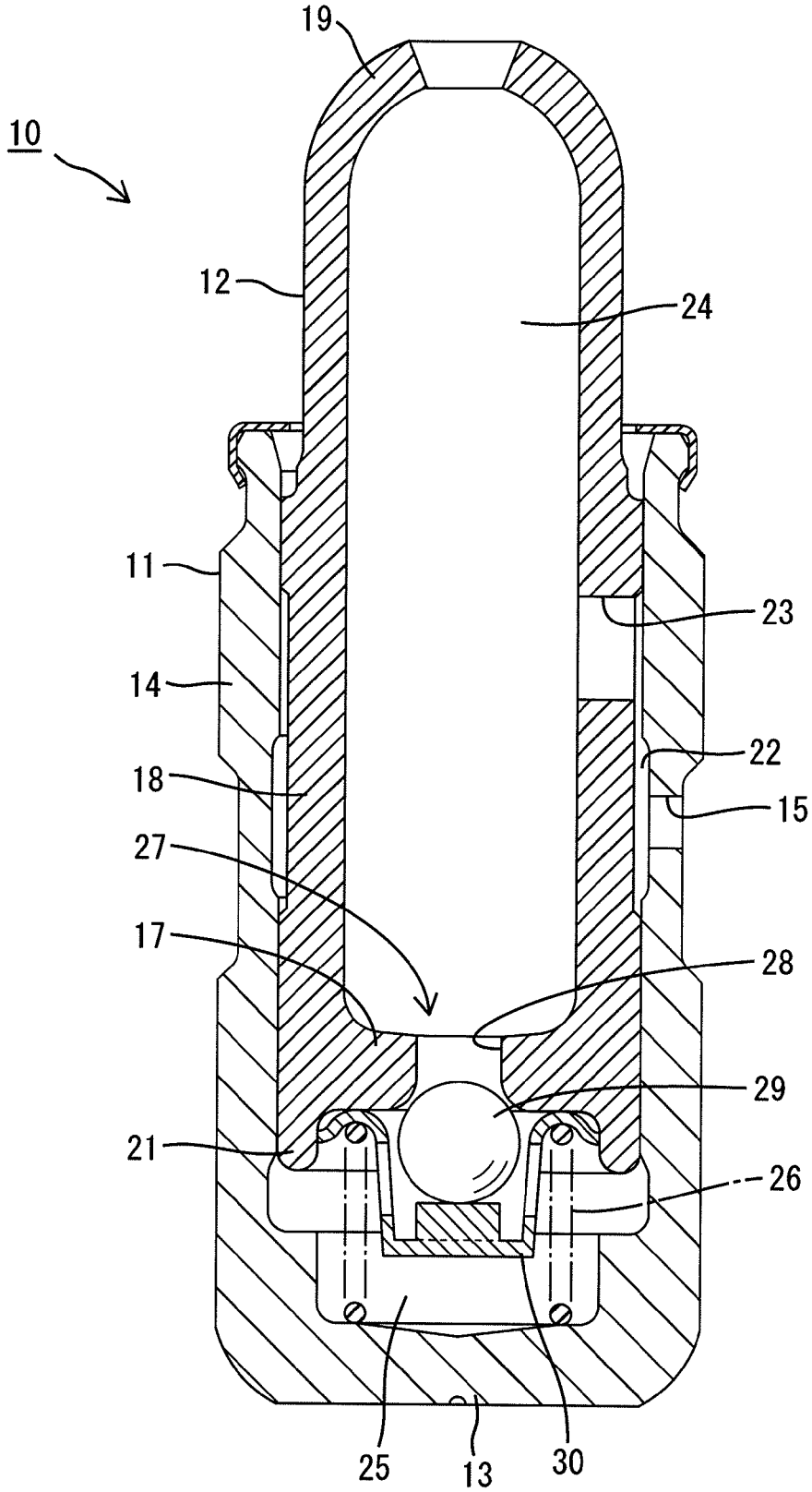
FIG. 1 is a sectional view of a lash adjuster according to a first embodiment.
Figure 2:
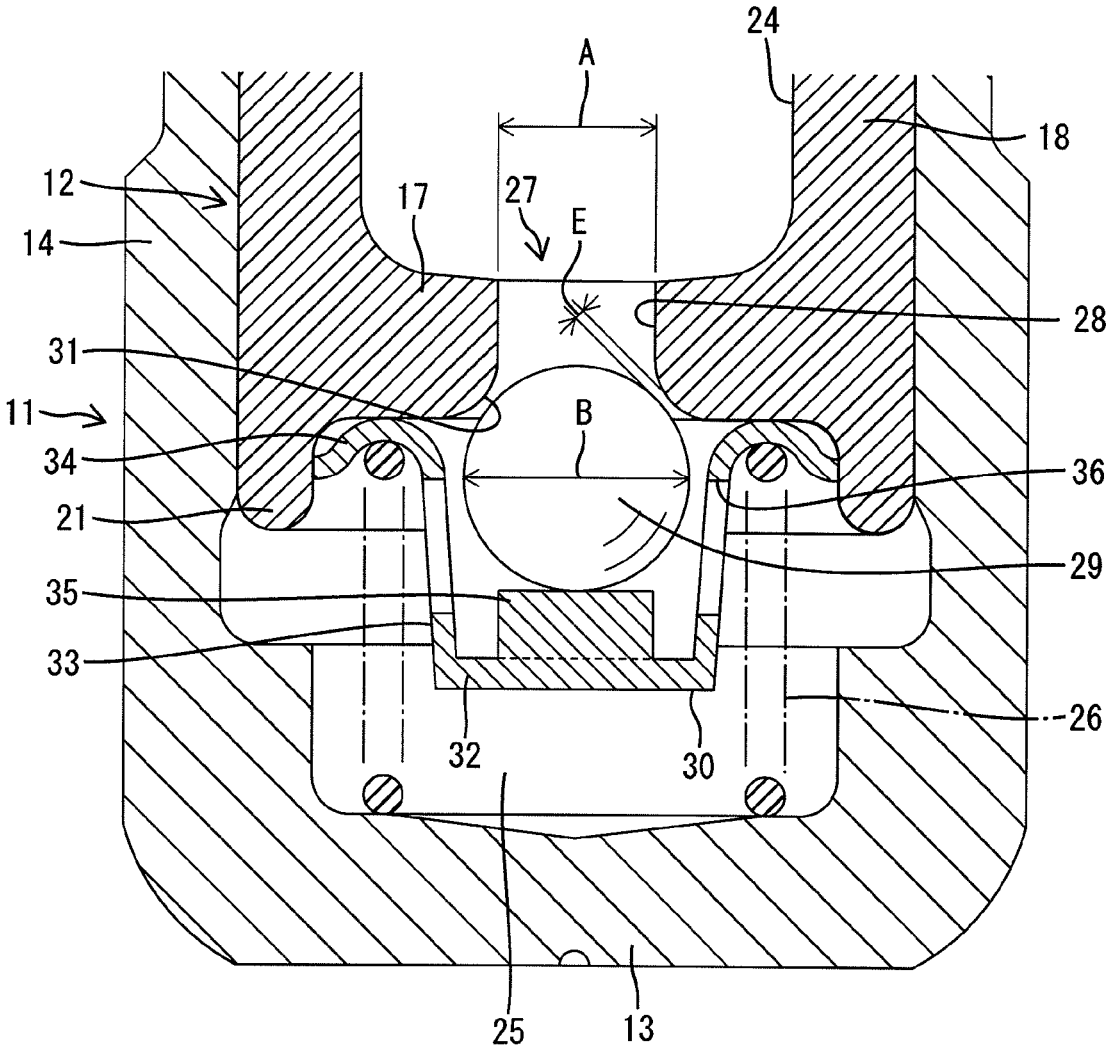
FIG. 2 is a partially enlarged sectional view of a check valve in a valve-opened state.
Figure 3:
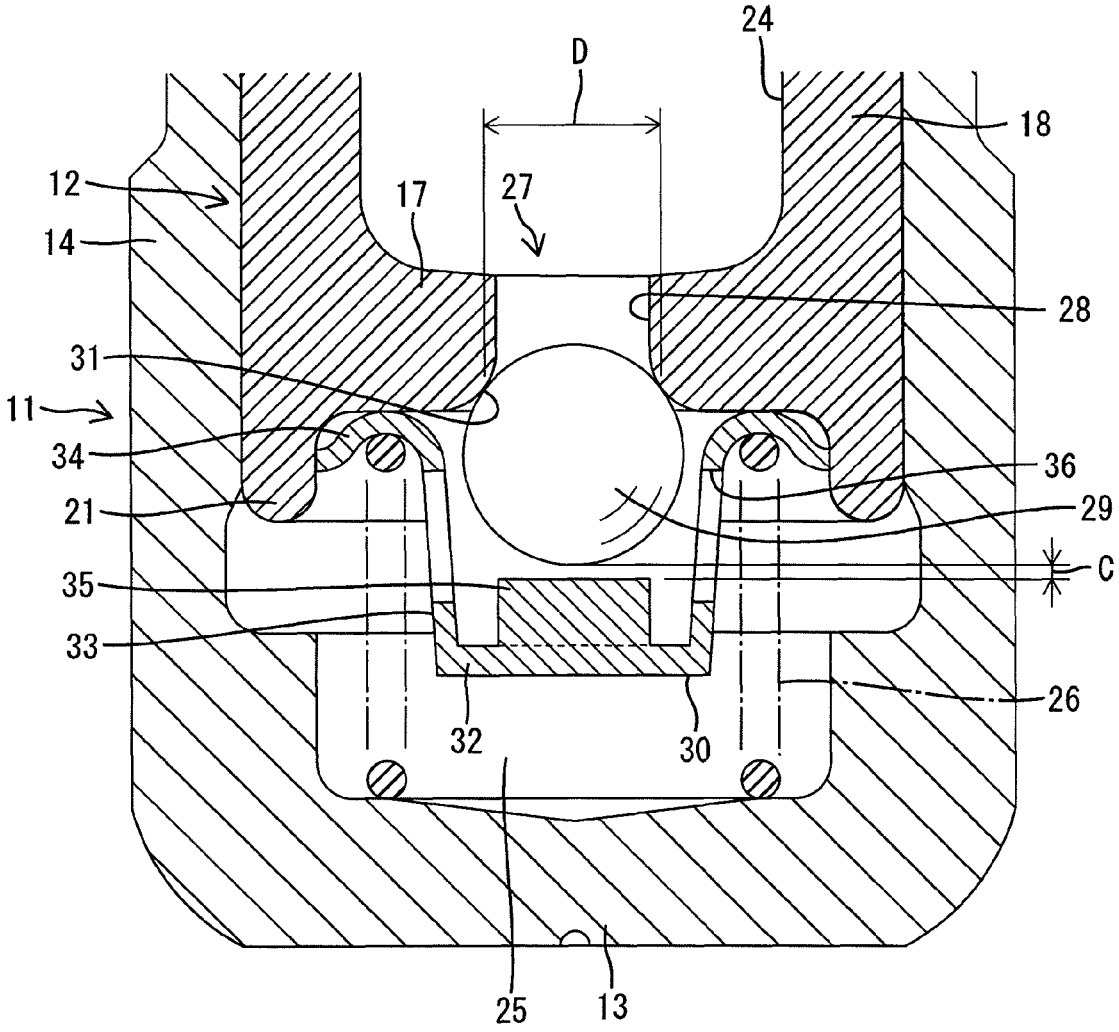
FIG. 3 is a partially enlarged sectional view of the check valve in a valve-closed state.

A first embodiment will be described with reference to FIGS. 1 to 3. The hydraulic lash adjuster 10 according to the embodiment is applied to a valve gear (not shown) of an internal combustion engine. The valve gear will first be described. The valve gear comprises a valve, the lash adjuster 10, a rocker arm and a cam. With rotation of the cam, the rocker arm moves the valve upward and downward while being swung vertically with an upper end of the lash adjuster 10 serving as a fulcrum, as well known in the art.

The lash adjuster 10 will now be described. The lash adjuster 10 comprises a body 11, a plunger 12 and a check valve 27. The body 11 includes a circular bottom wall 13 and a cylindrical circumferential wall 14 rising from a circumferential edge of the bottom wall 13 and is formed into a bottomed cylindrical shape. The body 11 is fixed in a mounting hole (not shown) which is open at an upper surface of a cylinder head (not shown). The circumferential wall 14 of the body 11 has an outer communication hole 15 formed therethrough. The communication hole 15 is located near an upper end of the circumferential wall 14 and communicates with an operating fluid supply path (not shown) provided in the cylinder head.

The plunger 12 includes a circular bottom wall 17 and a cylindrical circumferential wall 18 rising from a circumferential edge of the bottom wall 17 and is formed into a bottomed cylindrical shape. The plunger 12 is fitted into the body 11 from above so as to be movable upward and downward while an outer circumferential surface thereof is in sliding contact with an inner circumferential surface of the body 11. The plunger 12 has an upper end protruding upward from an upper end of the body 11. The upper end of the plunger 12 is formed with a substantially semispherical (dome-shaped) support 19. The rocker arm is abutted against an outer surface (an upper surface) of the support 19 thereby to support the rocker arm at a fulcrum point thereof. In other words, the plunger 12 is adapted to be subjected to a downward load from the rocker arm.

The circumferential wall 18 of the plunger 12 has an inner communication hole 23 formed therethrough. The outer and inner communication holes 15 and 23 communicate with each other through a circumferential communication path 22 formed between the inner circumference of the circumferential wall 14 of the body 11 and an outer circumference of the circumferential wall 18 of the plunger 12. Furthermore, a rib 21 is formed on an underside of the plunger 12 or the bottom wall 17 of the plunger 12 so as to protrude downward from an outer circumferential edge of the underside into a concentric circular shape. The plunger 12 has an interior serving as a low pressure chamber 24. A high pressure chamber 25 is provided in a hollow lower interior of the body 11 and separated from the low pressure chamber 24 by the bottom wall 17 of the plunger 12.

A check valve 27 includes a valve hole 28, a retainer 30 and a valve element 29. The check valve 27 allows an operating fluid to flow from the low pressure chamber 24 into the high pressure chamber 25 through the valve hole 28 when in a valve-opened state. The check valve 27 cuts off flow of the operating fluid from the high pressure chamber 25 into the low pressure chamber 24 through the valve hole 28 when in a valve-closed state.

The valve hole 28 is formed through the bottom wall 17 of the plunger 12 so as to be concentric with the bottom wall 17 and so as to extend vertically. The bottom wall 17 has an opening edge which is located at the lower side of the valve hole 28 (the high pressure chamber 25 side) and formed with a sheet surface 31 which has a generally quadrant arc-shaped section and is expanded downward (a form in which a diameter is rendered larger as the sheet surface 31 comes near the high pressure chamber 25 side).

The retainer 30 includes a base plate 32 which is made of a metal and is circular in shape and concentric with the valve hole 28, a circular cylindrical portion 33 extending upward from an outer circumferential edge of the base plate 32, and a spring bracket 34 which extends so as to be folded from an upper edge of the cylindrical portion 33 to the outer circumferential side into a concentric and generally semicircular arc shape. Thus, the retainer 30 is formed into a bottomed cylindrical shape as a whole. The base plate 32 has a larger diameter than the valve element 29 and includes a central portion (namely, a region on which the valve element 29 occupying the valve-opened position is placed) with a thicker portion 35 which is formed by swelling an upper surface of the central portion into a concentric shape. The thicker portion 35 has a smaller diameter than the valve element 29 which will be described in detail later. Furthermore, the cylindrical portion 33 is formed into such a shape as to surround the valve element 29 accommodated in the retainer 30. The cylindrical portion 33 further has a plurality of openings 36 formed therethrough circumferentially equiangularly.

The retainer 30 is disposed in the high pressure chamber 25 and mounted on the plunger 12 so that the spring bracket 34 is fitted with an inner circumference of the rib 21 and abutted against the underside of the bottom wall 17. A return spring 26 which comprises a compression coil spring and is coaxial with the valve hole 28 is accommodated in the high pressure chamber 25. The return spring 26 has a coil diameter which is smaller than an inner diameter of the rib 21 and larger than an outer diameter of the cylindrical portion 33 of the retainer 30. The return spring 26 has a lower end which is abutted on a bottom surface (the upper surface of the bottom wall 13) of the high pressure chamber 25 and an upper end which is abutted on a recessed underside of the spring bracket 34 thereby to be mounted between the retainer 30 and the bottom wall 13 of the body 11 in an elastically deflected state (an elastic restoring force stored state). The elastic restoring force of the return spring 26 biases the plunger 12 and the retainer 30 so that the plunger 12 and the retainer 30 are integrally moved upward relative to the body 11.

The valve element 29 comprises a spherical member made of steel (SUJ2) and is disposed in the high pressure chamber 25. The valve element 29 is held between a part of the bottom wall 17 located in the cylindrical portion 33 of the retainer 30 and the thicker portion 35 (the base plate 32) and is upwardly and downwardly movable by a slight distance between a valve-opened position (see FIG. 2) and the valve-closed position (see FIG. 3) located higher than the valve-opened position within a range from the aforesaid part of the bottom wall 17 and the thicker portion 35. When occupying the valve-opened position, the valve element 29 is placed on the upper surface of the thicker portion 35. When occupying the valve-closed position, the valve element 29 is abutted on the sheet surface 31 in a liquid-tight manner thereby to close the valve hole 28.

Furthermore, the upper end of the valve element 29 is kept surrounded by the sheet surface 31 even when the valve element 29 occupies either valve-opened or valve-closed position. When the valve element 29 occupies the valve-opened position, a horizontal gap between the valve element 29 and the sheet surface 31 becomes maximum. The aforesaid horizontal direction is perpendicular to the movement direction between the valve-opened and valve-closed positions of the valve element 29. However, since the gap is small, there is no possibility that the valve element 29 is horizontally displaced to a large extent or deviated from the valve hole 28 to a large extent. In other words, the sheet surface 31 has a function of guiding the valve element 29.

In the embodiment, the inner diameter A of the valve hole 28 ranges from 2 to 2.2 mm. The valve element 29 has a diameter B that is 3 mm and larger than the inner diameter A of the valve hole 28. A vertical stroke C between the valve-opened and valve-closed positions of the valve element 29 ranges from 0.05 to 0.2 mm. A diameter D of abutment area (abutment circle) between the valve element 29 and the sheet surface 31 is 2.38 mm when the valve element 29 is located at the valve-closed position. A minimum gap E between the valve element 29 and the sheet surface 31 ranges from 0.05 to 0.2 mm when the valve element 29 is located at the valve-opened position. Additionally, the valve element 29 has a specific gravity of 7.8.

The operating fluid supplied from the supply path of the cylinder head into the lash adjuster 10 flows sequentially through the outer communication hole 15, the communication path 22 and the inner communication hole 23 to be stored in the low pressure chamber 24. The operating fluid further flows through the valve hole 28 of the check valve 27 to fill the high pressure chamber 25.

The operation of the lash adjuster will be described. When the plunger 12 remains still without vertical movement, the valve element 29 is located at the valve-opened position where the valve element 29 is placed on the upper surface of the thicker portion 35 of the retainer 30 by the self-weight thereof and the check valve 27 is maintained in the valve-opened state as shown in FIG. 2.

When load is applied from the rocker arm to the plunger, while the plunger 12 remains still, the plunger 12 starts moving downward. The operating fluid in the high pressure chamber 25 flows through the slight gap between the valve element 29 and sheet surface 31 and the valve hole 28 into the low pressure chamber 24. Since the fluid pressure in the gap between the valve element 29 and the sheet surface 31 is reduced, the valve element 29 is sucked to the sheet surface 31 at that moment thereby to be moved upward to the valve-closed position. As a result, the valve hole 28 is closed such that the check valve 27 is closed, as shown in FIG. 3.

Since the upper end of the valve element 29 is surrounded by the sheet surface 31 when the valve element 29 is moved upward, the valve element 29 can reliably abut against the sheet surface 31 without positional displacement to a large extent in the horizontal direction (the direction perpendicular to the movement direction between the valve-opened and valve-closed positions). Furthermore, since the sheet surface 31 is formed into such a shape that the diameter thereof is reduced toward the valve hole 28, the valve element 29 is guided so as to come near the valve hole 28. Accordingly, the valve element 29 can reliably close the valve hole 28 (or reach the valve-closed position). Furthermore, since the valve element 29 is surrounded by the cylindrical portion 33 in the retainer 30, the provision of the cylindrical portion 33 can prevent the valve element 29 from positional displacement in the horizontal direction.

The time required from the start of downward movement of the plunger 12 to the switching of the check valve 27 to the valve-closed state is very short. After the check valve 27 has been closed, the operating fluid in the high pressure chamber 25 flows through a slight gap between the outer circumferential surface of the plunger 12 and the inner circumferential surface of the body 11 with the downward movement of the plunger 12, further flowing through the inner communication hole 23 into the low pressure chamber 24.

When the plunger 12 is released from the load applied from the rocker arm during downward movement thereof, the biasing force of the return spring 26 causes the plunger 12 to start moving upward. When the negative pressure is then established in the interior of the high pressure chamber 25, the valve element 29 is moved downward from the valve-closed position to the valve-opened position. Accordingly, the valve hole 28 is opened such that the check valve 27 is switched to the valve-opened state. As a result, with the upward movement of the plunger 12, the operating fluid in the low pressure chamber 24 flows sequentially through the valve hole 28, an inner space of the retainer 30 and the opening 36 into the high pressure chamber 25.

Furthermore, when the load applied from the rocker arm to the plunger 12 is increased during upward movement of the plunger 12 such that the plunger 12 starts moving downward, the operating fluid in the high pressure chamber 25 instantaneously flows through the valve hole 28 into the low pressure chamber 24 and thereupon, the valve element 29 is moved up to the valve-closed position. The valve element 29 is placed on the upper surface of the thicker portion 35 of the retainer 30 when located at the valve-opened position. In other words, the valve element 29 abuts against the thicker portion 35 thereby to be reliably stopped at the valve-opened position when moved downward from the valve-closed position toward the valve-opened position with change in the movement of the plunger 12 from descent to ascent. Thus, the valve element 29 is prevented from being excessively moved downward past the valve-opened position. Accordingly, the valve element 29 can promptly reach the valve-closed position without delay in the returning operation to the valve-closed position when the plunger 12 is changed from ascent to descent. Furthermore, since the thicker portion 35 against which the valve element 29 displaced to the valve-opened position abuts has a sufficiently high stiffness, the thicker portion 35 is hard to deform even when the valve element 29 abuts or collides against the thicker portion 35.

The check valve 27 of the lash adjuster 10 according to the above-described embodiment includes the valve hole 28 formed through the bottom wall 17 of the plunger 12, the retainer 30 which is disposed in the high pressure chamber 25 so as to be movable upward and downward with the plunger 12, and the valve element 29 which is movable upward and downward between the valve-opened position and the valve-closed position in the high pressure chamber 25. When the plunger 12 remains still, the valve element 29 is held at the valve-opened position while being placed on the retainer 30 by the self-weight.

When the plunger 12 is moved upward, the operating fluid in the low pressure chamber 24 flows through the valve hole 28 into the high pressure chamber 25 while the valve element 29 is held at the valve-opened position by the self-weight. In this case, the valve element 29 is maintained on the retainer 30 even when an ascent speed of the plunger 12 is high. Accordingly, the distance between the valve element 29 and the valve hole 28 is prevented from being increased. Consequently, when the plunger 12 thereafter starts the descent movement, the valve element 29 is promptly moved to the valve-closed position thereby to close the valve hole 28.

Providing a valve spring for biasing the valve element 29 to the valve-closed position side and increasing a biasing force of the valve spring is considered as a means for enhancing return of the valve element to the valve-closed position. In this case, however, there is a possibility that the valve element 29 is kept closing the valve hole 28 or that an opening degree of the valve hole 28 becomes insufficient such that a smooth upward movement of the plunger 12 is adversely affected. On the contrary, since no valve spring is used in the embodiment, there is no possibility that the upward movement of the plunger 12 is adversely affected by the use of the valve spring.

Furthermore, since the lash adjuster 10 is constructed so as not to use a valve spring biasing the valve element 29 to the valve-closed position side, the number of components can be reduced and the following effect can be expected as well. That is, when the plunger 12 remains still with the cam base circle pressing the rocker arm, the check valve 27 is maintained in the valve-opened state so that the operating fluid is allowed to flow through the valve hole 28. Accordingly, when a change in dimensional tolerance or rapid change in the temperature of the valve gear results in a slight change in the load the rocker arm applies to the plunger 12, the plunger 12 is allowed to be moved upward and downward with the check valve 27 being maintained in the valve-opened state. This can reduce the load applied to and avoid stress concentration on the valve, rocker arm, cam, plunger 12 or the like.

Other Embodiments

The embodiment described above with reference to the accompanying drawings should not be restrictive. For example, the embodiment may be modified as follows:

(1) Although the valve element is made of the steel (SUJ2) in the foregoing embodiment, the valve element may be made of a metal other than the steel or of ceramics including silicon nitride having a smaller specific gravity than metals.

(2) Although the valve element has a diameter of 3 mm in the foregoing embodiment, the diameter of the valve element may be smaller or larger than 3 mm.

(3) Although the vertical stroke between the valve-opened and valve-closed positions of the valve element ranges from 0.05 to 0.2 mm in the foregoing embodiment, the vertical stroke of the valve element may be smaller than 0.05 mm and larger than 0.2 mm.

The invention claimed is:

1. A lash adjuster comprising:

a bottomed cylindrical body;

a bottomed cylindrical plunger which is movable upward and downward while being in sliding contact with an inner circumferential surface of the body and which is biased upward by a return spring;

a low pressure chamber defined in the plunger for storing an operating fluid;

a high pressure chamber defined in a hollow lower interior of the body and separated from the low pressure chamber by a bottom wall of the plunger, the high pressure chamber being configured to be filled with the operating fluid; and a check valve which allows the operating fluid to flow from the low pressure chamber into the high pressure chamber when in a valve-opened state and which cuts off flow of the operating fluid from the high pressure chamber into the low pressure chamber when in a valve-closed state, the check valve including a valve orifice extending through the bottom wall of the plunger, a retainer disposed in the high pressure chamber so as to be moved upward and downward with the plunger, and a valve element which is vertically movable in the high pressure chamber between a valve-opened position at which the valve element is placed on the retainer while spaced from the valve orifice and a valve-closed position which is located higher than the valve-opened position and at which the valve element closes the valve orifice, the valve element being held in the valve-opened position by self-weight when the plunger remains still, wherein the retainer includes:

a base plate on which the valve element located at the valve-opened position is placed; and a cylindrical portion extending upward from an outer circumferential edge of the base plate so as to surround the valve element, and wherein:

the cylindrical portion has a plurality of flow openings formed therethrough circumferentially equiangularly;

the base plate includes a central portion on which the valve element is placed and which has an upper surface formed with a swollen portion, and wherein the flow openings in the cylindrical portion have lower edging that falls below a height level of the upper surface of the central portion.

2. The lash adjuster according to claim 1, wherein the valve element comprises a spherical member and the central portion of the base plate with the swollen upper surface has a smaller diameter than the valve element.

3. The lash adjuster according to claim 1, wherein the valve orifice has an opening edge which is located at the high pressure chamber side and formed with a sheet surface having a diameter expanded to the high pressure chamber side.

4. The lash adjuster according to claim 3, wherein the valve element has an upper end which is held surrounded by the sheet surface both when the valve element is located at the valve-opened and valve-closed positions.

5. The lash adjuster according to claim 1 wherein said swollen portion comprises a centrally located cylindrical disk having an axial thickness greater than a supporting portion of said circumferential edge of the base plate.

6. The lash adjuster according to claim 1, wherein said check valve is configured such that said valve element adjusts in operation within a preexisting clearance range defined between the upper surface and the bottom wall of the plunger, and wherein the valve element is free from contact with a valve spring.

7. A lash adjuster comprising:

a bottomed cylindrical body;

a bottomed cylindrical plunger which is movable upward and downward while being in sliding contact with an inner circumferential surface of the body and which is biased upward by a return spring;

a low pressure chamber defined in the plunger for storing an operating fluid;

a high pressure chamber defined in a hollow lower interior of the body and separated from the low pressure chamber by a bottom wall of the plunger, the high pressure chamber being configured to be filled with the operating fluid; and a check valve which allows the operating fluid to flow from the low pressure chamber into the high pressure chamber when in a valve-opened state and which cuts off flow of the operating fluid from the high pressure chamber into the low pressure chamber when in a valve-closed state, the check valve including a valve orifice extending through the bottom wall of the plunger, a retainer disposed in the high pressure chamber so as to be moved upward and downward with the plunger, and a valve element which is vertically movable in the high pressure chamber between a valve-opened position at which the valve element is placed on the retainer while spaced from the valve orifice and a valve-closed position which is located higher than the valve-opened position and at which the valve element closes the valve orifice, the valve element being held in the valve-opened position by self-weight when the plunger remains still, wherein the retainer includes:

a base plate on which the valve element located at the valve-opened position is placed; and a cylindrical portion extending upward from an outer circumferential edge of the base plate so as to surround the valve element, and wherein;

the cylindrical portion has flow openings formed therethrough; and the base plate includes an axially thicker-in-material central portion, with the central portion having an upper surface on which the valve element is placed in the valve-opened position, and wherein the flow openings in the cylindrical portion have lower edging that falls below a height level of the upper surface of the central portion.

8. The lash adjuster according to claim 7, wherein the valve element comprises a spherical member and the central portion of the base plate has a smaller diameter than the valve element.

9. The lash adjuster according to claim 7, wherein the valve orifice has an opening edge which is located at the high pressure chamber side and formed with a sheet surface having a diameter expanded to the high pressure chamber side.

10. The lash adjuster according to claim 9, wherein the valve element has an upper end which is held surrounded by the sheet surface both when the valve element is in the valve-opened and valve-closed positions.

11. The lash adjuster according to claim 7, wherein the plurality of openings formed therethrough are arranged circumferentially equiangularly.

12. The lash adjuster according to claim 7, wherein the valve orifice has an opening edge which is located at the high pressure chamber side and formed with a sheet surface having a diameter expanded to the high pressure chamber side and wherein said plunger has an axially extending, lower circumferential rib having an interior surface extending about a spring catch region of said retainer, and said interior surface extends off of said sheet surface as to provide a curved, non-interrupted surface extending from the sheet surface to a free end of said rib.

13. A lash adjuster comprising:

a bottomed cylindrical body;

a bottomed cylindrical plunger which is movable upward and downward while being in sliding contact with an inner circumferential surface of the body and which is biased upward by a return spring;

a low pressure chamber defined in the plunger for storing an operating fluid;

a high pressure chamber defined in a hollow lower interior of the body and separated from the low pressure chamber by a bottom wall of the plunger, the high pressure chamber being configured to be filled with the operating fluid; and a check valve which allows the operating fluid to flow from the low pressure chamber into the high pressure chamber when in a valve-opened state and which cuts off flow of the operating fluid from the high pressure chamber into the low pressure chamber when in a valve-closed state, the check valve including a valve orifice extending through the bottom wall of the plunger, a retainer disposed in the high pressure chamber so as to be moved upward and downward with the plunger, and a valve element which is vertically movable in the high pressure chamber between a valve-opened position at which the valve element is placed on the retainer while spaced from the valve orifice and a valve-closed position which is located higher than the valve-opened position and at which the valve element closes the valve orifice, the valve element being held in the valve-opened position by self-weight when the plunger remains still, wherein the retainer includes:

a base plate on which the valve element located at the valve-opened position is placed; and a cylindrical portion extending upward from an outer circumferential edge of the base plate so as to surround the valve element, wherein;

the cylindrical portion has an opening formed therethrough; and the base plate includes a central portion, with the central portion having an upper surface on which the valve element is placed in the valve-opened state, and wherein there are a plurality of circumferentially spaced flow openings in the cylindrical portion having lower edging that falls below a height level of the upper surface of the central portion, and wherein the valve orifice has an opening edge which is located at the high pressure chamber side and formed with a sheet surface having a diameter expanded to the high pressure chamber side, and wherein the valve element has an upper end which is held surrounded by the sheet surface both when the valve element is in the valve-opened and valve-closed positions.

14. The lash adjuster according to claim 13, wherein the valve element comprises a spherical member and the central portion of the base plate has a smaller diameter than the valve element.

15. The lash adjuster according to claim 13, wherein said plunger has an axially extending, lower circumferential rib having an interior surface extending about a spring catch region of said retainer, and said interior surface of the rib extends off of said sheet surface as to provide a curved non-interrupted surface extending from the sheet surface to a free end of said rib.

16. The lash adjuster according to claim 15, wherein the spring catch retainer is a circumferential flange extension extending outward from an upper region of the cylindrical portion of the retainer, and said flange extension comprises a curved spring reception region and, farther outwardly positioned, a bent section extending to the interior surface of the rib.

17. The lash adjuster according to claim 13, wherein the cylindrical portion has a plurality of openings formed therethrough circumferentially equiangularly.

* * * * *